US006022202A

United States Patent [19]

Pottier et al.

[11] Patent Number: 6,022,202

[45] Date of Patent: Feb. 8, 2000

[54] SPIRAL VACUUM PUMP HAVING A TOOTHED CIRCULAR TRANSLATION MOVEMENT LIMITER DEVICE

[75] Inventors: Daniel Pottier, Le Chateau d'Olonne; Rémy LeClaire, Corneville sur Risle, both of France

[73] Assignee: S.B.P.V. (Societe Des Brevets P. Vulliez), Pont Audemer, France

[21] Appl. No.: 08/894,637

[22] PCT Filed: Feb. 23, 1996

[86] PCT No.: PCT/FR96/00290

§ 371 Date: Aug. 25, 1997

§ 102(e) Date: Aug. 25, 1997

[87] PCT Pub. No.: WO96/26367

PCT Pub. Date: Aug. 29, 1996

[30] Foreign Application Priority Data

Feb. 24, 1995 [FR] France ..... 95 02209

[51] Int. Cl.[7] ..... F04C 18/04

[52] U.S. Cl. ..... 418/55.3; 418/55.4; 418/55.5

[58] Field of Search ..... 418/55.3, 55.4, 418/55.5, 57; 464/102

[56] References Cited

U.S. PATENT DOCUMENTS

| | | | |
|---|---|---|---|
| 3,802,809 | 4/1974 | Vulliez | 418/55.4 |
| 4,178,143 | 12/1979 | Thelen et al. | 418/57 |
| 4,795,323 | 1/1989 | Lessie | 418/55.3 |

FOREIGN PATENT DOCUMENTS

| | | | |
|---|---|---|---|
| 0 513 827 | 11/1992 | European Pat. Off. . | |
| 32 43 571 | 5/1984 | Germany . | |
| 57-212303 | 12/1982 | Japan . | |
| 58-096193 | 6/1983 | Japan . | |
| 58-106190 | 6/1983 | Japan . | |
| 58-160579 | 9/1983 | Japan . | |
| 59-224401 | 12/1984 | Japan . | |
| 61-014493 | 1/1986 | Japan . | |
| 61-58993 | 3/1986 | Japan | 418/55.3 |
| 2245488 | 10/1990 | Japan | 418/55.4 |

*Primary Examiner*—John J. Vrablik
*Attorney, Agent, or Firm*—Young & Thompson

[57] ABSTRACT

A vacuum pump with a circular translation cycle includes a fixed body (100) having a fixed disk (114) which is provided on at least one of its sides with a spiral-shaped protuberance (123), a movable disk (131) opposite to the stationary disk (114) and having also at least one spiral-shaped protuberance (133) interleaved with the spiral protuberance (123) of the fixed disk (114) and having the same angular amplitude, a mechanism by means of which the moveable disk (131) is connected to the body (100) and supported thereby in order to control a circular translation motion of the moveable disk (131) with respect to body (100), a motor (120) for driving the moveable disk (131) through a pump shaft (140), and a pump having a limiter device for limiting the circular translation motion. The mechanism includes two bearings (182, 190) carried by the pump shaft (140), which is in a central position with respect to the fixed body (100). The circular translation motion limiting device includes a crown (201) having fixed teeth (202) between which are imbricated the teeth (212) integral with the moveable disk (131).

9 Claims, 3 Drawing Sheets

212
203
Rp
204
r
α
165
R
205

202
Rp
R
α
155
r
204
205
203

200
212
212
212
155
201
180
165
202
202
202
170

SPIRAL VACUUM PUMP HAVING A TOOTHED CIRCULAR TRANSLATION MOVEMENT LIMITER DEVICE

The present invention concerns a pump, in particular a vacuum pump, with circular translation cycle.

To be more precise, it concerns a vacuum pump with circular translation cycle comprising a stationary body with a stationary disk that includes, at least on one side thereof, a spiral-shaped projection, a movable disk facing the stationary disk and also including at least one spiral-shaped projection interleaved with the spiral-shaped projection of the stationary disk and with the same angular range, a mechanism by which the movable disk is connected to said body and supported by it, for driving circular translational motion of the movable disk relative to said body during operation of the pump, actuating means for driving the movable disk by means of a pump shaft so that it effects said circular translation movement, said pump also comprising a device for limiting relative circular translation movement guiding the movable disk in its circular translation movement and avoiding any torsion.

A pump of this kind is described in FR-A-2 141 402, for example. Although a pump of this kind as described in the aforementioned document gives excellent results, it nevertheless has the drawback of comprising many components and of being bulky, especially in the radial direction, in particular because said mechanism is made up of three cranks coupled and synchronized together and disposed at the periphery of the pump, these cranks themselves assuring limitation of the relative circular translation movement.

An aim of the present invention is to provide a pump of the above type that does not have these drawbacks.

Accordingly, in accordance with the invention, a vacuum pump with circular translation cycle include a stationary body including at least one stationary disc which has on one face a spiral-shaped projection, a moveable disk facing the stationary disk and also having at least one spiral-shaped projection interleaved with the spiral-shaped projection of the stationary disk and with the same angular range, a mechanism by which the moveable disk is connected to said body and supported by it, for driving circular translational motion of the moveable disk relative to said body during operation of the pump, actuating means for driving the mobile disk by means of a pump shaft so that it effects said circular translation movement, said pump also including a device for limiting relative circular translational movement, said mechanism comprising at least one bush carried by the pump shaft, characterized in that said pump shaft is centered relative to the stationary body and the circular translational movement limiter device comprises a ring having stationary teeth between which teeth attached to the moveable disc are interleaved.

A limiter device of the above design is capable of assuring the relative movement limitation (anti-torsion) function even if the pump is rated to generate large volumes up to 100 $m^3/h$, even 500 $m^3/h$, and even beyond this.

Preferably, the stationary teeth are limited by cylindrical surfaces with axes parallel to the axis of the pump and the section of which in a plane perpendicular to said axis is composed of circular arcs of radius R and r, respectively, the centers of which are on a circle of radius $R_p$ centered on said axis, arcs lying inside and arcs lying outside said circle.

Advantageously, the moveable teeth are limited by cylindrical surfaces with axes parallel to the axis of the pump and the section of which in a plane perpendicular to said axis is composed of arcs of the same circles respectively outside and inside said circle.

Preferably, $\alpha$ being the angle between two stationary teeth or movable teeth and E being the eccentricity, which corresponds to the radius of the cylinder traced out by the moveable axis around the stationary axis of the pump, $$R = R_p \mathrm{Sin}\frac{\alpha}{4} + \frac{E}{2} \quad \text{and}$$

$$r = R_p \mathrm{Sin}\frac{\alpha}{4} - \frac{E}{2}.$$

Advantageously, the crank radius is adjustable.

Preferably, the axis of the passage which receives the end of the pump shaft is slightly offset relative to the axis of the exterior surface of the bush in which said passage is formed and which supports the moveable disk through the intermediary of bearings received by said exterior surface; advantageously, the eccentric bearing surface of the pump shaft has its axis offset relative to the axis of a ring which surrounds it and which receives a bearing for a bearing hub.

Preferably, said mechanism comprises two axially spaced bearing bushes around the pump shaft.

Advantageously, it further comprises a metal sealing bellows surrounding the pump shaft and one end of which is fastened to the moveable disk and the other to the stationary body.

Preferably, it comprises only one spiral-shaped projection on the stationary disk and only one spiral-shaped projection on the moveable disk.

Advantageously, the spiral-shaped projections of the stationary disk and the spiral-shaped projections of the moveable disk are separated by a constant small clearance regardless of the position of the moveable disk.

The features and advantages of the invention will emerge from the following description given by way of example with reference to the accompanying drawings, in which.

Figure 1:
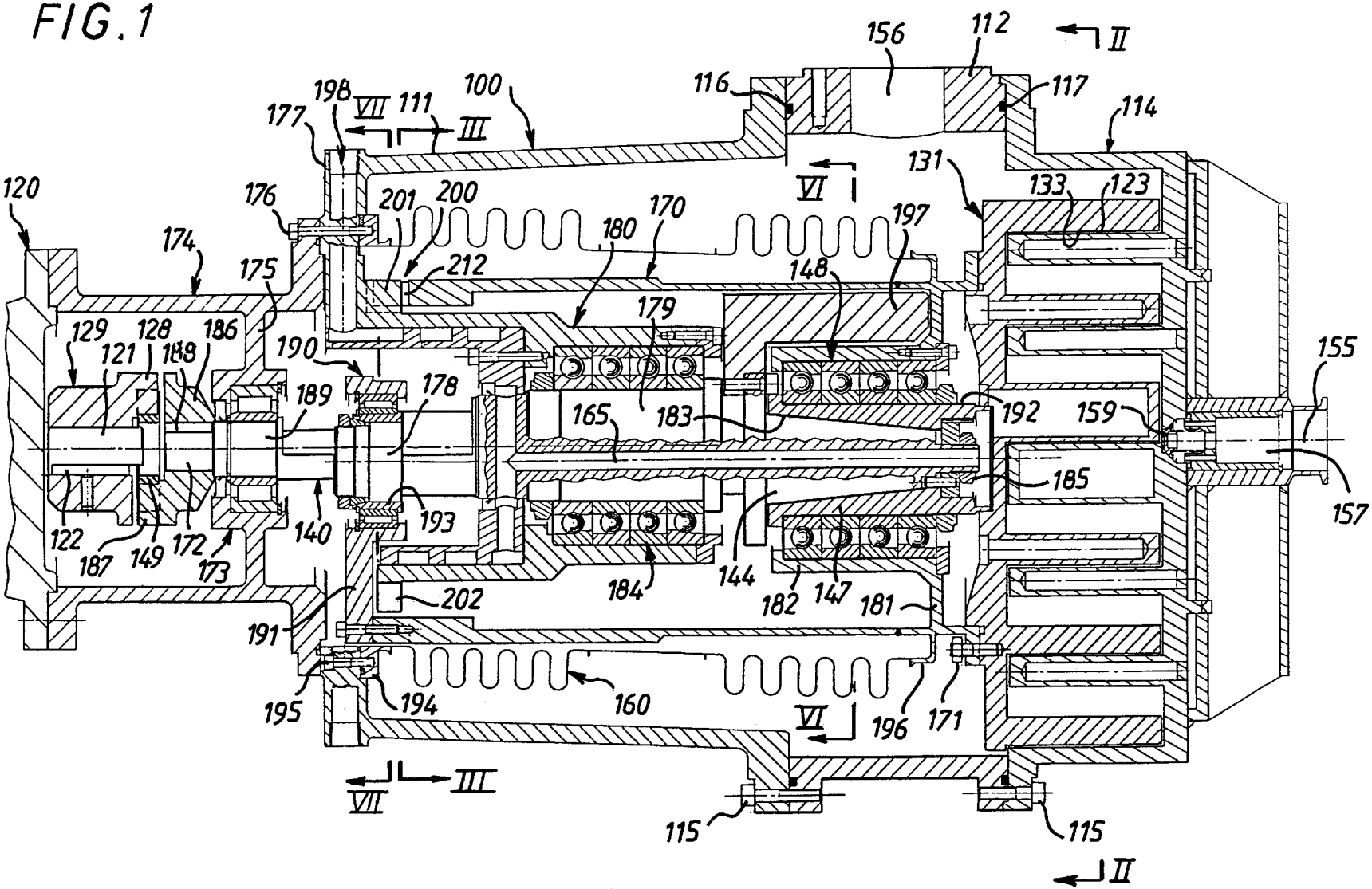
FIG. 1 is a fragmentary longitudinal section of a pump in accordance with the invention.

Referring to FIGS. 1 through 7, a pump in accordance with the invention comprises a stationary body 100 constituted of a sleeve 111, a spacer 112 and a flange 114 assembled together by screws 115 with seals 116, 117 between them; the side of the flange 114 facing inwards, i.e. towards the sleeve 111, includes a spiral-shaped projection 123 which is interleaved with a spiral-shaped projection 133 with the same angular range on one side of a moveable plate 131; the other side of this movable plate 131 supports a generally cylindrical hollow shaft 170 secured by screws 171.

Figure 2:
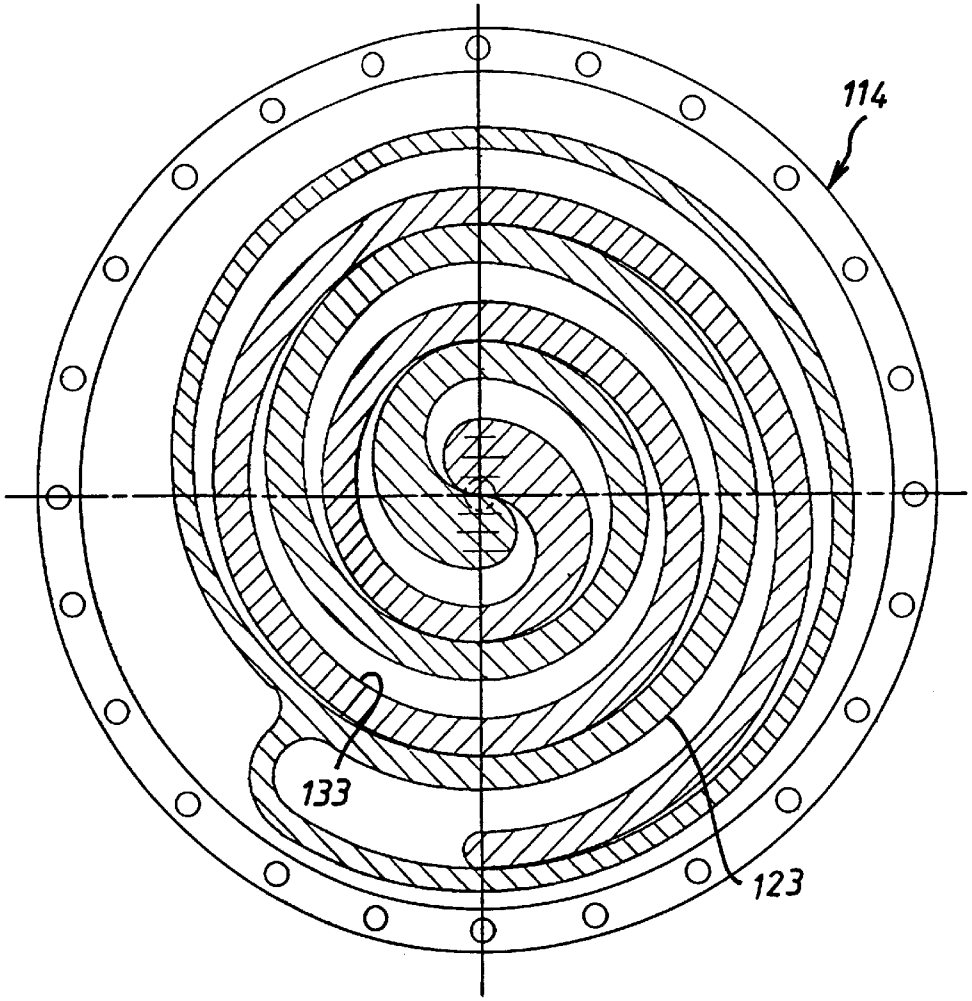
FIG. 2 is a section taken along the line II—II in FIG. 1.

The spiral-shaped projections 123 and 133 are separated by a constant small clearance regardless of the position of the moveable disk 131; this clearance, which is generally in the order of tens of microns, has been exaggerated in FIG. 2 so that it can be seen.

At the end fixed to the plate 131, the hollow shaft 170 has a radial rim 181 extended towards the interior of the hollow shaft 170 by a ring 182 supporting bearing means 148 installed inside the ring 182; the bearing means 148 surround a bush 147 on which they are mounted, said bush 147 having a frustoconical internal passage 183 the larger diameter opening of which is at the end facing towards the interior of the hollow shaft 170.

At the end opposite that cooperating with the spacer 112, the sleeve 111 has radial arms 177 directed towards the interior of the sleeve 111, for example three such radial arms 177 spaced by 120°, only one of them being visible in FIG. 1; a generally cylindrical bush 180 extends axially from the interior end of the arms 177, along the axis 155 of the pump, inside the sleeve 111, the bush 180 extending also inside the hollow shaft 170; near its innermost end, relative to the sleeve 111, the bush 180 supports the outside of bearings means 184.

By means of the screws 176, the radial fingers 177 of the sleeve 111 support the outside of a casing 174 connecting the pump to a motor 120 shown only in part and the end 121 of the drive shaft of which can be seen; the casing 174 has an internal wall 175 carrying a bearing bush 173.

The pump includes a pump shaft 140; the pump shaft 140 has a frustoconical end 144 the shape of which is complementary to that of the passage 183 in the bush 147; the bush 147 is fastened to the end 144 of the pump shaft 140 by nesting and clamping arrangements 185; the other end 172 of the shaft 140 drives rotation of the shaft 140 from the motor 120; to this end, the drive shaft 121 is constrained by a key 122 to rotate with a drive nut 129, the end 172 of the pump shaft 140 being constrained by a key 188 to rotate with a driven nut 186; the driving nut 129 and the driven nut 186 carry respective fingers 128, 187 coupled by a flexible coupling 149.

The pump shaft 140 has two cylindrical bearing surfaces coaxial with the axis 155 of the pump: a bearing surface 179 in its central region cooperating with the bearing means 184 and a bearing surface 189 near its end 172 and supported by the bearing bush 173; the frustoconical end 144 of the shaft 140 has an axis 165 offset relative to the axis 155 but parallel to it; this is the axis of the hollow shaft 170.

To assure that the axes 155 and 165 are strictly parallel, another bearing surface 178 eccentric relative to the axis 155 can be provided, as in the embodiment shown; this bearing surface 178 coaxial with the axis 165 supports a bearing hub 190 coupled to the hollow shaft 170 by radial arms 191 circumferentially interleaved between the radial arms 177 fastened to the sleeve 111.

Figure 5:
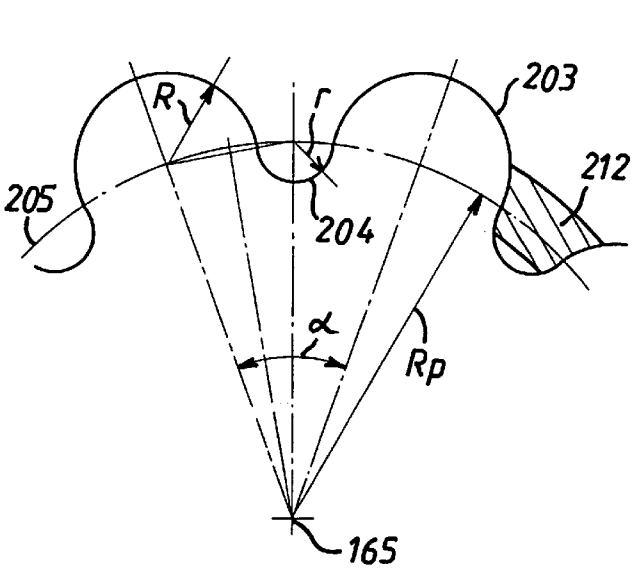
FIGS. 4 and 5 are geometrical diagrams showing the construction of the teeth of the device from FIG. 3.
Figure 4:
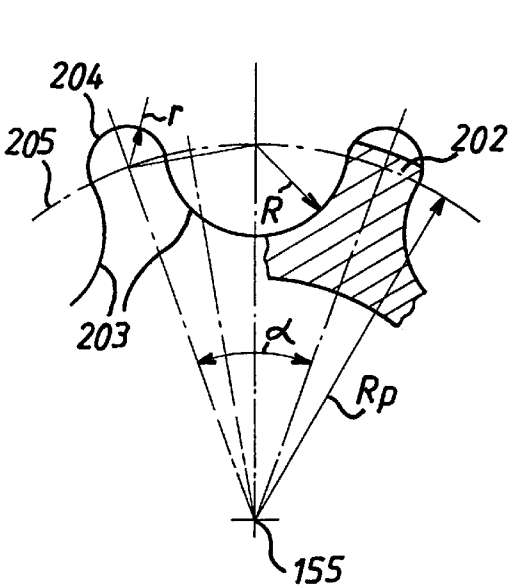
Figure 3:
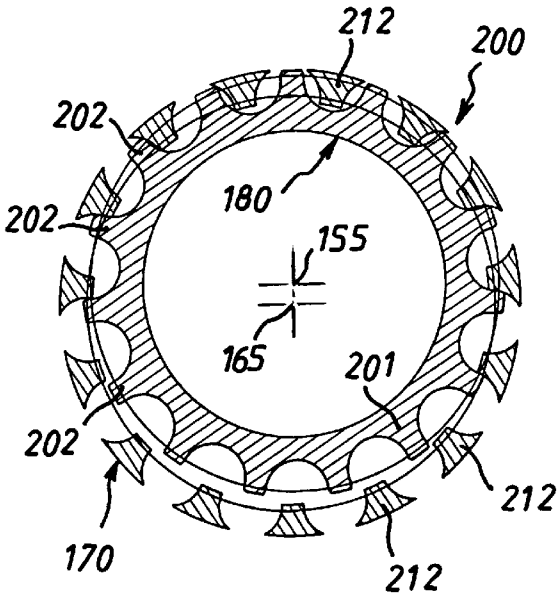
FIG. 3 is a section taken along the line III—III in FIG. 1.

In accordance with an important feature of the invention, a device 200 is provided for limiting relative movement in circular translation; in accordance with the invention, this device comprises a ring 201 having teeth 202 attached to the frame 100 between which teeth 212 at the free transverse end of the moveable hollow shaft 170 are interleaved; as can be seen more clearly in FIGS. 3 through 5, the stationary teeth 202 and the movable teeth 212 have semi-circular profiles constructed from circles of radius R and r the centers of which are on a so-called primitive circle of radius $R_p$; to be more precise, the stationary teeth 202 are limited by cylindrical surfaces having axes parallel to the axis 155 and the section of which in a plane perpendicular to the axis 155 is composed of circular arcs 203, 204 with respective radii R and r, the centers of which are on a circle 205 of radius $R_p$ centered on the axis 155, the arcs 203 lying within the circle 205 and the arcs 204 outside it; the moveable teeth 212 are limited by cylindrical surfaces with axes parallel to the axis 165 or 155 and the section of which in a plane perpendicular to those axes is also composed of circular arcs 203, 204, the arcs 203 lying outside the circle 205 and the arcs 204 inside it; the angle $\alpha$ between two teeth 202 or 212 depends of course on the number N of teeth: $\alpha=2\pi/N$; the axis 155 is stationary and the axis 165 traces out a cylinder around the axis 155 the radius of which corresponds to the eccentricity E; by choosing radii R and r such that R=r+E, the teeth 212 follow the profile of the teeth 202 so that the hollow shaft 170, and therefore the plate 131, are guided in their circular translation movement, without any torsion. It can be seen from FIGS. 4 and 5 that E, $\alpha$, $R_p$, R and r are related by the equation $$Rp \cdot \mathrm{Sin}\frac{\alpha}{4} = \frac{1}{2}(R + r)$$

which, combined with the previous equation giving the eccentricity, gives $$R = R_p \mathrm{Sin}\frac{\alpha}{4} + \frac{E}{2},\ r = R_p \mathrm{Sin}\frac{\alpha}{4} - \frac{E}{2}.$$

Figure 6:
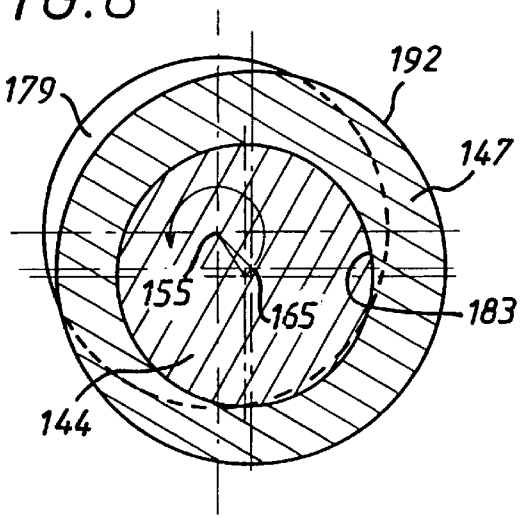
FIGS. 6 and 7 are sections to a larger scale taken along the lines VI—VI and VII—VII, respectively, in FIG. 1.
Figure 7:
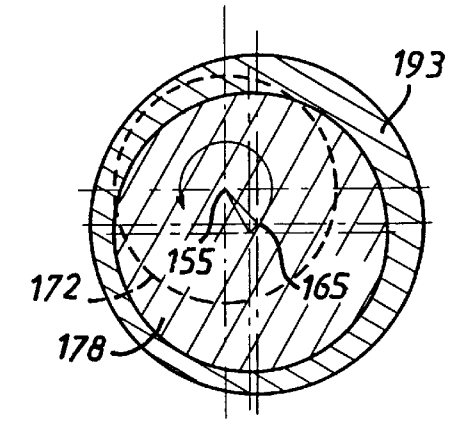

The invention also makes provision for adjusting the eccentricity, as shown in FIGS. 6 and 7; in FIG. 6, the axis of the frustoconical end 144 of the pump shaft 140, and therefore the axis of the passage 183 which receives it, is slightly offset relative to the axis 165 of the exterior surface 192 of the bush 147 which receives the bearings 148 which support the hollow shaft 170; the eccentricity E being the transverse offset between this axis 165 and the axis 155 of the cylindrical bearing surface 179 of the pump shaft 140, mechanically coupled to the frustoconical part 144, it can be seen that it is sufficient to turn the bush 147 relative to it to vary the distance between the axis 165 and the axis 155, i.e. the eccentricity E.

A similar assembly enables commensurate adjustment of the eccentricity E in line with the bearing hub 190; as can be seen in FIG. 7, the eccentric hearing surface 178 of the pump shaft 140 has its axis offset relative to the axis of a ring 193 which surrounds it and which receives the bearing of the bearing hub 190; once again, turning the ring 193 relative to the shelf 140 modifies the distance between the axes 155 and 165.

In the pump just described the plane of inertia of the moving masses is axially in line with the spacer 112; accordingly, a single dynamic balancing weight 197 attached to the bush 147 in this region is sufficient to balance the assembly.

The inlet 156 of the pump is radial and in the spacer 112 and the outlet 157 is axial and downstream of a check valve 159.

As soon as the pump starts, the pumped fluid is subjected to the continuous and progressive effect of compression due to movement in circular translation of the moveable spiral-shape projections relative to the stationary spiral-shaped projections.

If desired, the pump enclosure, in which the vacuum is produced, can be totally isolated from the exterior and from the remainder of the pump; as shown in FIG. 1, all that is required is to provide a metal bellows 160 around the hollow shaft 170; one end of the bellows 160 is fixed to a flange 196 on the exterior surface of the hollow shaft 170 in line with its radial rim 181; the other end of the bellows 160 is fixed to a ring 194 attached to the stationary body 100 by the screws 176 and screws 195. An arrangement of this kind increases the number of possible applications of the pump, which is a so-called dry pump the active parts of which are isolated from the exterior and free of any lubricant, oil or grease.

The metal bellows 160 used to seal the pumping system completely is therefore positively protected against any functional or accidental torsion force by the limiter device 200; as a result there is virtually no limit on the service life of the bellows 160.

A pump of the above kind designed to generate volumes of up to 500 $m^3$/hour or above is advantageously provided with a cooling oil circuit the inlet 198 of which can be seen in FIG. 1.

We claim:

1. A vacuum pump with a circular translation cycle, comprising:

a stationary body including at least one stationary disc which has on one face a first spiral-shaped projection;

a moveable disk facing the stationary disk and having at least one second spiral-shaped projection interleaved with the first spiral-shaped projection of the stationary disk and with the same angular range;

first teeth attached to the moveable disk;

a mechanism by which the moveable disk is connected to said body and supported by it, for driving circular translational motion of the moveable disk relative to said body during operation of the vacuum pump;

a pump shaft;

actuating means for driving the moveable disk by means of the pump shaft so that it effects the circular translation movement;

a device for limiting relative circular translational movement;

said mechanism comprising at least one bush carried by the pump shaft;

said circular translational movement limiter device comprising a ring having stationary teeth between which the first teeth attached to the moveable disc are interleaved;

wherein the stationary teeth are limited by cylindrical surfaces with axes parallel to a stationary axis of the vacuum pump and the section of which in a plane perpendicular to the stationary axis is composed of first and second circular arcs of radius R and r, respectively, the centers of which are on a circle of radius $R_p$ centered on the stationary axis, the first arcs lying inside said circle and the second arcs lying outside said circle, and wherein R and r are not the same radius and wherein the centers of the first and second arcs are circumferentially offset from each other on the circle.

2. A vacuum pump with a circular translation cycle, comprising:

a stationary body including at least one stationary disc which has on one face a first spiral-shaped projection;

a moveable disk facing the stationary disk and having at least one second spiral-shaped projection interleaved with the first spiral-shaped projection of the stationary disk and with the same angular range;

first teeth attached to the moveable disk;

a mechanism by which the moveable disk is connected to said body and supported by it, for driving circular translational motion of the moveable disk relative to said body during operation of the vacuum pump;

a pump shaft;

actuating means for driving the moveable disk by means of the pump shaft so that it effects the circular translation movement;

a device for limiting relative circular translational movement;

said mechanism comprising at least one bush carried by the pump shaft;

said circular translational movement limiter device comprising a ring having stationary teeth between which the first teeth attached to the moveable disc are interleaved;

wherein the stationary teeth are limited by cylindrical surfaces with axes parallel to a stationary axis of the vacuum pump and the section of which in a plane perpendicular to the stationary axis is composed of first and second circular arcs of radius R and r, respectively, the centers of which are on a circle of radius $R_p$ centered on the stationary axis, the first arcs lying inside said circle and the second arcs lying outside said circle, and wherein the moveable teeth are limited by cylindrical surfaces with axes parallel to the stationary axis and the section of which in a plane perpendicular to the stationary axis is composed of third and fourth circular arcs of radius R and r, respectively, the third arcs lying outside said circle and the fourth arcs lying inside said circle.

3. The pump according to claim 2, wherein said pump shaft is centered relative to the stationary body.

4. Pump according to claim 2, wherein $\alpha$ is an angle between two of the stationary teeth or the movable teeth and E is an eccentricity that corresponds to the radius of the cylinder traced out by movement of a moveable axis of the moveable disk around the stationary axis, and where $$R = R_p \mathrm{Sin}\frac{\alpha}{4} + \frac{E}{2} \text{ and } r = R_p \mathrm{Sin}\frac{\alpha}{4} - \frac{E}{2}.$$

5. The pump according to claim 2, wherein an axis of a passage which receives an end of the pump shaft is slightly offset relative to a moveable axis of an exterior surface of the bush in which said passage is formed and which supports the moveable disk through the intermediary of bearings received by said exterior surface.

6. The pump according to claim 2, wherein an eccentric bearing surface of the pump shaft has its axis offset relative to an axis of a ring which surrounds it and which receives a bearing for a bearing hub.

7. The pump according to claim 2, wherein said mechanism comprises two axially spaced bearing bushes around the pump shaft.

8. The pump according to claim 2, further comprising a metal sealing bellows surrounding the pump shaft and one end of which is fastened to the moveable disk and the other to the stationary body.

9. The pump according to claim 2, comprising only one first spiral-shaped projection on the stationary disk and only one second spiral-shaped projection on the moveable disk.

* * * * *